US007802321B2

(12) United States Patent
Boyd

(10) Patent No.: US 7,802,321 B2
(45) Date of Patent: Sep. 28, 2010

(54) MOTORCYCLE HELMET COVER

(76) Inventor: Janice Boyd, 2204 Hunters Wood Way, Virginia Beach, VA (US) 23454

( * ) Notice: Subject to any disclaimer, the term of this patent is extended or adjusted under 35 U.S.C. 154(b) by 1255 days.

(21) Appl. No.: 11/280,499

(22) Filed: Nov. 16, 2005

(65) Prior Publication Data

US 2007/0107112 A1 May 17, 2007

(51) Int. Cl.
*A42B 1/24* (2006.01)

(52) U.S. Cl. ..... 2/422

(58) Field of Classification Search ..... 2/422, 2/410, 175.6

See application file for complete search history.

(56) References Cited

U.S. PATENT DOCUMENTS 3,155,981 A * 11/1964 McKissick et al. ..... 2/422
4,345,336 A * 8/1982 Plastino ..... 2/414
D362,085 S * 9/1995 Hause et al. ..... D29/122
5,743,458 A * 4/1998 French ..... 229/87.03
5,922,437 A * 7/1999 Bryant ..... 428/102
6,061,836 A * 5/2000 Peters ..... 2/175.6
6,101,636 A * 8/2000 Williams ..... 2/410
6,176,408 B1 * 1/2001 Miner et al. ..... 224/653
6,233,738 B1 * 5/2001 Siracusa ..... 2/4
6,237,162 B1 * 5/2001 Gill ..... 2/422
6,256,799 B1 * 7/2001 McGlasson et al. ..... 2/422
6,260,204 B1 * 7/2001 Morrissey ..... 2/172
6,711,752 B2 * 3/2004 Smith ..... 2/422
6,848,122 B1 * 2/2005 Meeds ..... 2/422

OTHER PUBLICATIONS

Helmet Skinz website page, http://www.motovationracing.com/index.html, last accessed Jun. 21, 2010.

* cited by examiner

*Primary Examiner*—Danny Worrell
(74) *Attorney, Agent, or Firm*—Connolly Bove Lodge & Hutz LLP

(57) ABSTRACT

A cover for decorating a motorcycle helmet, including a substantially circular exterior material portion, having variable decoration, connected anteriorly and at the sides to a substantially circular interior mesh material portion by a seam. The enclosure provides two openings on either side of the invention, providing spaces through which the helmet's chinstraps can be threaded through. The seam ends in the posterior of the enclosure to provide an opening in the back of the invention through which the helmet may be inserted. Both pieces of fabric provide corresponding non-permanent fastening agents which are used to secure the invention around the helmet inserted inside. Alternatively, the invention may be a cover for decorating a motorcycle helmet, including a substantially circular/helmet shaped silicone skin/elastic material portion, having an opening on either side of the enclosure through which the helmet's chinstraps can be threaded through, and a formed lip around the edge of the enclosure which wraps around the exterior of the helmet to fit on the interior, as to secure the invention to the helmet in a non-permanent fashion.

10 Claims, 8 Drawing Sheets

MOTORCYCLE HELMET COVER

There are no related patent applications.

This application did not receive federal research and development funding.

BACKGROUND OF THE INVENTION

The present invention generally relates to a decorative motorcycle helmet cover. More particularly, the invention relates to a motorcycle helmet cover that allows users to readily change the exterior color and design of their helmet so that the user is able to color coordinate entire outfits when dressing for a motorcycle ride. The helmet cover may comprise various types of materials including cloth or a malleable, elastic silicone skin to cover the exterior of a motorcycle helmet every instance.

There are many types of motorcycle helmet designs and colors. However, there are no motorcycle helmets available that can change their exterior to fit the day-to-day needs of the motorcycle rider. Often, the helmet will not match what the user wears every day. The present invention allows the user to easily change the exterior of a motorcycle helmet to fit his or her day-to-day needs.

BRIEF SUMMARY OF THE INVENTION

The invention, a motorcycle helmet cover, is a new type of decorative cover that utilizes either a material such as cloth or a malleable, elastic silicone skin to cover the exterior of a motorcycle helmet. The exterior cloth or skin is available in a variety of colors and designs and may be easily removed and replaced with another cover. Alternatively, the cover may be removed and the motorcycle helmet used without the cover.

The cloth embodiment of the invention comprises a decorative piece of cloth slightly larger than the exterior surface area of the helmet to fit over the helmet when placed on top of it. An anterior end of the cloth is attached to a mesh netting cloth that is slightly shorter in length than the colored cloth. The mesh is secured to the cloth by a stitched seam running half-way down the length of the colored cloth on both sides. On both sides, midway down the length of the stitching there is a break or gap in the seam on both sides. The mesh is then secured again to the cloth by a seam three quarters of the length of the cloth on both sides. These gaps in the stitched seam provide holes through which a motorcycle's helmet straps are threaded. The remaining edges of the cloth and mesh create a large opening. Fastening means are secured around the opening for closing the covering around the helmet. The large opening comprises flaps in the posterior of the covering. The helmet may be passed through this opening in the cover and the cover thereafter closed through a hook and loop fastening means, zipper, buttons or the like. In this embodiment, the cloth is presented on an exterior of the helmet, whereas the mesh is formed to the interior of the helmet. Velcro®, a zipper or buttons are placed on both flaps so that the cloth can be attached to the mesh fabric in a non-permanent fashion after the helmet is deposited between the cloth and mesh.

A user easily slides the motorcycle helmet into the cover, with the cloth facing outward and the mesh covering the inside of the helmet. The user then pulls the chin straps through the unstitched gap between the two fabrics. The user then pulls the excess cloth over a posterior region of the helmet and tucks it under the helmet and fastens it inside the helmet to the Velcro®, zipper or button fasteners. The cloth material may comprise iridescent threads or other reflective materials that reflect light to aid in motorcycle safety.

In a second embodiment of the invention, a malleable silicone is formed in the shape of a motorcycle helmet. In this embodiment, a colored piece of elastic silicone slightly larger than the exterior surface area of the helmet and shaped substantially like a helmet is fitted to an exterior surface of the helmet. The malleable silicone cover may include a lip that is tucked under the sides of the helmet and include open holes through which helmet straps can be threaded. At the bottom of the silicone skin is a lip long enough to wrap under the helmet and cling slightly to the inside of the helmet. In a further embodiment, the silicone covering is shaped in the profile of the helmet without the lip and openings. The silicone covering is fitted to the exterior of the helmet and exerts surface tension to hold the covering in place.

In the silicone embodiment, a user slides the motorcycle helmet into the invention by stretching the skin over the helmet, leaving the silicone skin facing outward. The user then pulls the chin straps through the openings, if the cover includes openings. Next, the user pulls the lip skin under the bottom of the helmet, securing it inside the helmet, if the cover includes a lip. The silicone skin's surface elasticity, coefficient of friction and surface tension causes the skin to cling to the helmet without the use of Velcro®, button fasteners or alternative fastening means. After removing the cover from the helmet, the skin retains the shape of the helmet.

An object of the invention is to enable the user to quickly and easily change the exterior look of a motorcycle helmet by covering it and secure the cover over the helmet so that the cover will not become dislodged while riding on a motorcycle.

Another object of the invention is to provide a novel motorcycle helmet cover that can be easily changed to a cover that matches a particular riding outfit.

A further object of the invention is a motorcycle helmet cover that may be manufactured in either cloth material or a malleable stretchy silicone skin/material.

Additional objects and advantages of the invention will be set forth in part in the description which follows, and in part will be obvious from the description, or may be learned from practicing the invention. The objects and advantages of the invention will be obtained by means of instrumentalities in combinations particularly pointed out in the appended claims.

DETAILED DESCRIPTION OF THE INVENTION

The following is the preferred embodiment or best mode for carrying out the invention. It should be noted that this invention is not limited by the discussion of the preferred embodiment.

Figure 1B:
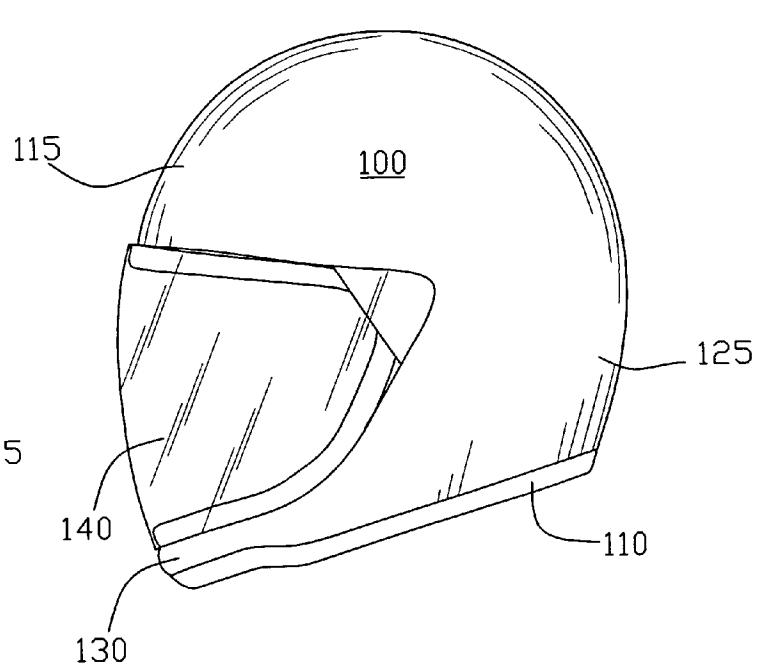
FIG. 1B is a side elevation view of an additional prior art helmet comprising a face shield.
Figure 1A:
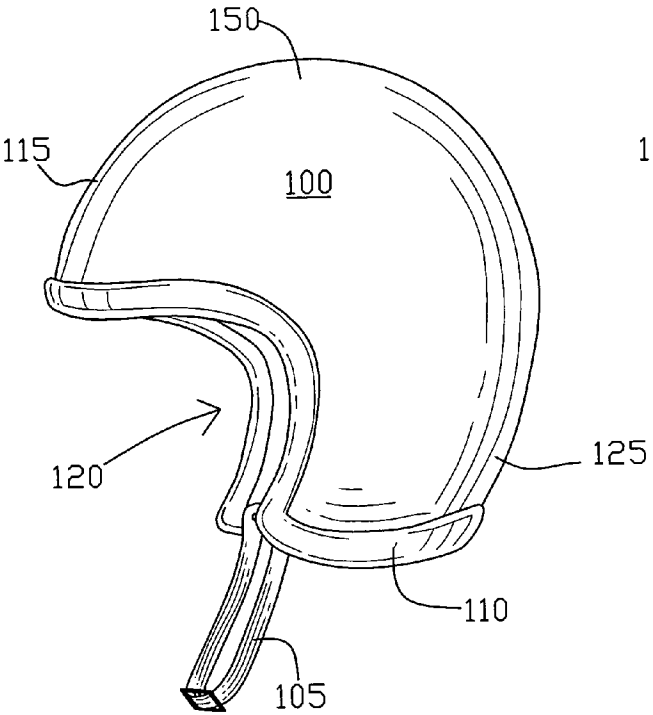
Figure 1A Prior Art
FIG. 1A is a side elevation view of a prior art helmet.

FIG. 1A depicts a first prior art motorcycle helmet 100. Typically, the helmet 100 comprises hardened plastic material for protecting a rider's head from impacting hard objects. The helmet 100 includes a face opening 120 arranged at a front region 115. A curved top 150 is provided between the front region 115 and back 125. Straps 105 are provided for securing the helmet 100 to the head of a motorcycle rider. Lip 110 surrounds the face opening 120 and extends along the entire edge of the helmet including back 125, as shown. FIG. 1B is an additional type of prior art helmet and includes a face opening 120 that is arranged at a front region 115 of the helmet 100. The helmet 100 includes a lower strip 130 as shown. Face guard 140 is arranged across a front of the helmet 100 and may be rotated upward in a known manner to create a face opening. A chinstrap is not shown in this embodiment.

Figure 2A:
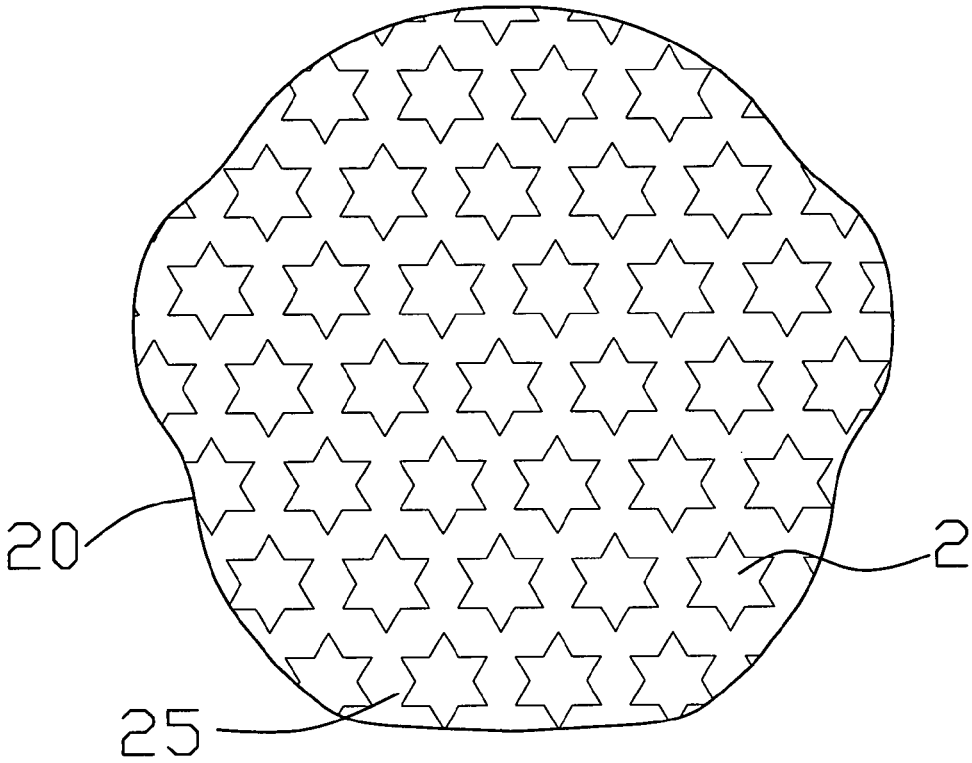
FIG. 2A is a plan view of a cloth that forms the exterior portion of the cover in a first embodiment of the invention.
Figure 2B:
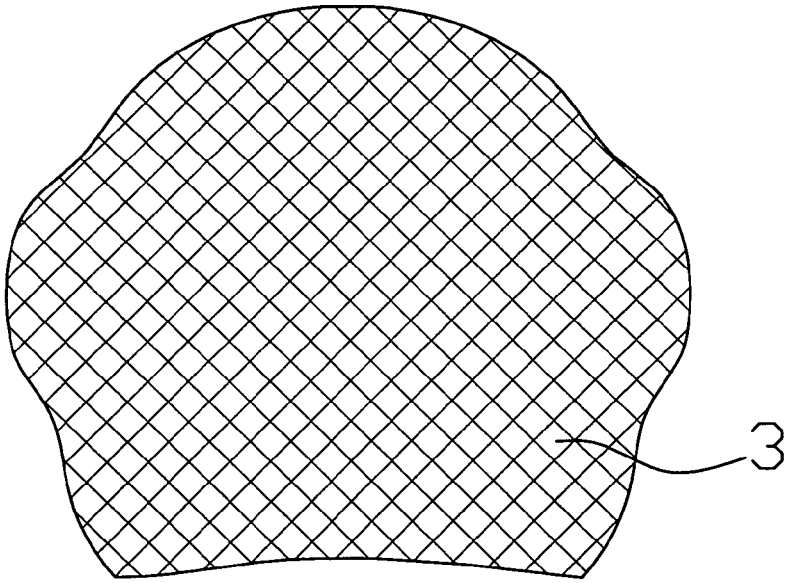
FIG. 2B is a plan view of a piece of mesh material that forms an interior element of the cover in the first embodiment of the invention.

The motorcycle helmet cover of the present invention may be manufactured in either cloth material or a malleable stretchy silicone skin. As shown in FIGS. 2A and 2B, in the first embodiment, the invention comprises a decorative piece of cloth 20, of variable designs and colors 2, slightly larger than the surface area of a motorcycle helmet and for covering an exterior surface of the motorcycle helmet. A piece of stretchable material, preferably mesh netting cloth 3, is slightly shorter than the decorative cloth 20 and for covering an interior surface of the helmet. It is important that the interior strip of cloth be stretchable to avoid discomfort. The surface area of the mesh cloth 3 is smaller than that of the cloth 20. Moreover, cloth 20 comprises a flap 25 that overlaps the back edge of the helmet and secures in a manner described hereinafter.

Figure 3A:
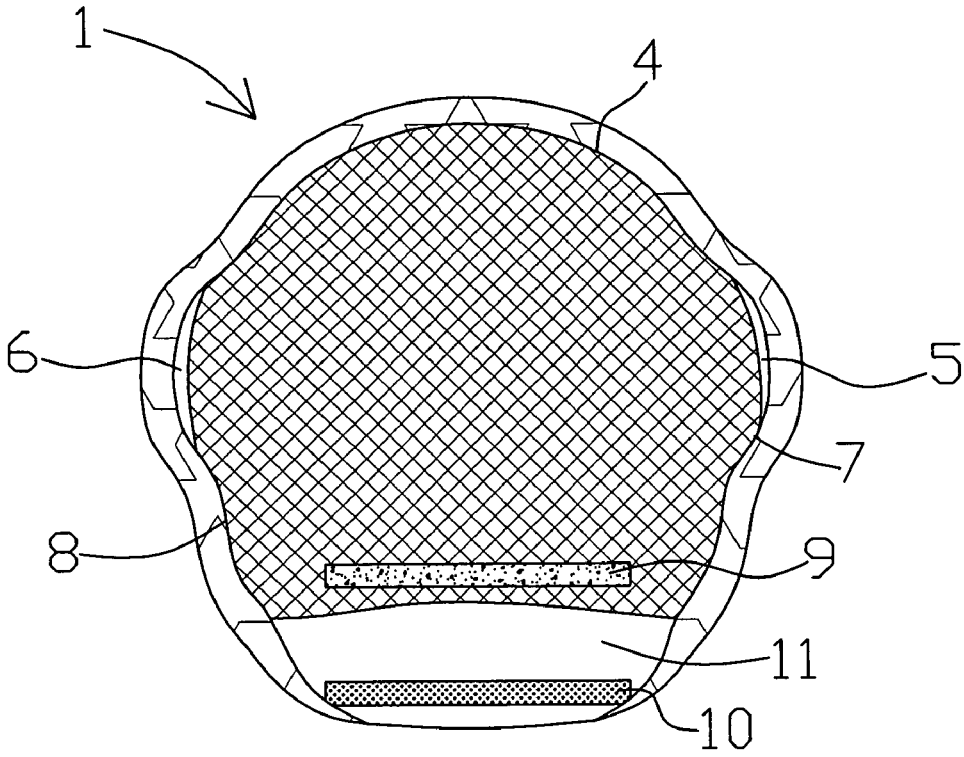
FIG. 3A is a plan view from beneath the cover of the first embodiment of the invention and showing the cloth and mesh of FIGS. 2A and 2B sewn together and showing a hook and loop closure means arranged on edges of the opening.
Figure 3B:
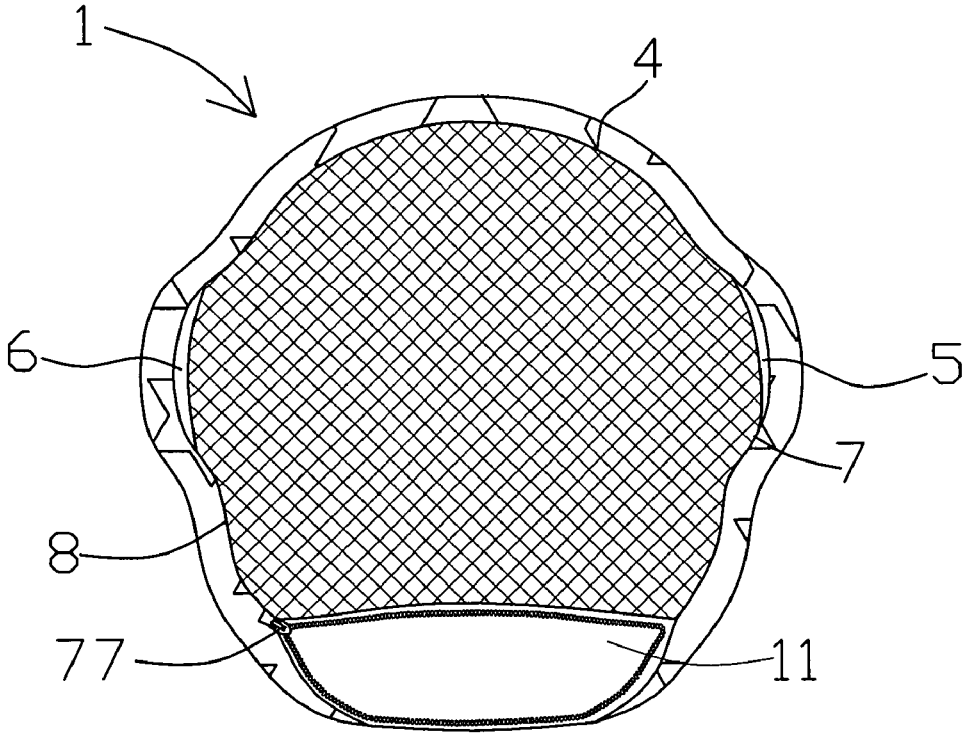
FIG. 3B is a plan view from beneath the cover and showing a zipper closure means arranged on edges of the opening.
Figure 3C:
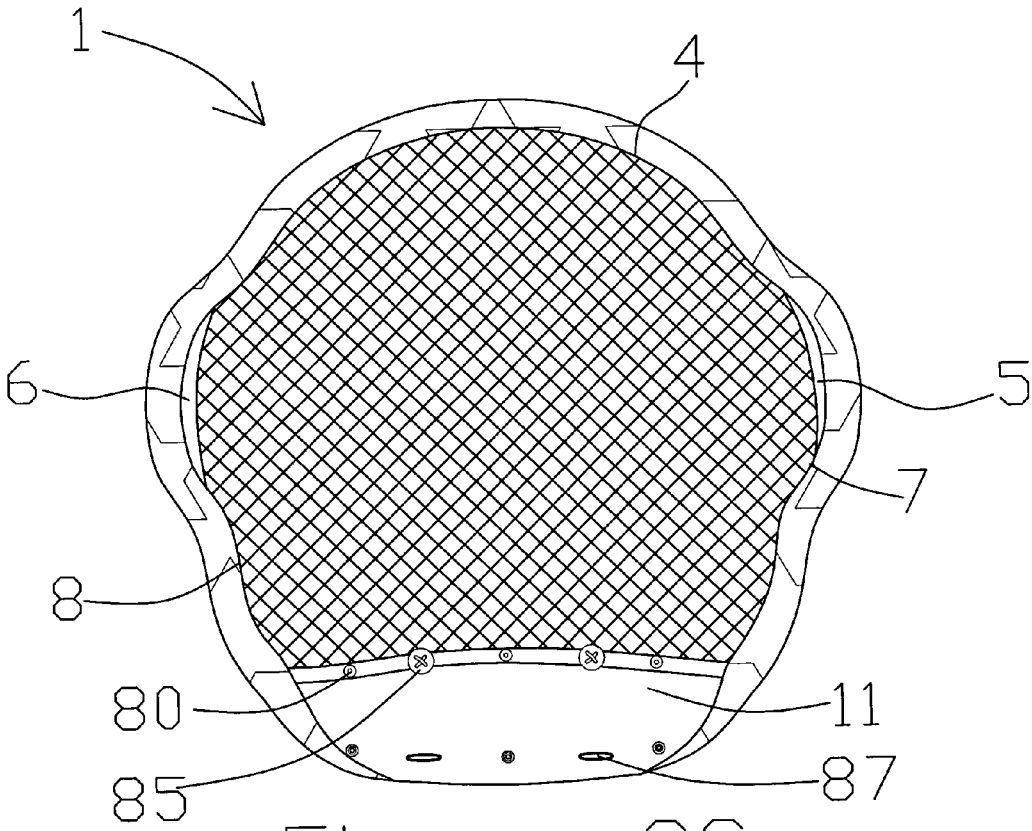
FIG. 3C is a plan view from beneath the cover and showing button fasteners for closing the opening.

FIGS. 3A through 3C show the first embodiment of the cover 1. The mesh 3 is secured in an anterior region to the cloth 20 by a seam 4. Half way down the length of the seam there is a break in the seam on both sides to create openings 5,6 and the mesh is secured again to the cloth by a seam on both sides 7, 8. These openings 5, 6 allow chin straps 105 to be threaded through the cover 1. Opening 11 is provided at a posterior end of the cover and created by both cloth 20 and mesh 3. In FIG. 3A, a strip of hook and loop material 9 is attached across the mesh near the opening 11 as shown. A complementary strip of hook and loop material 10 is provided on flap 25. As can be readily appreciated by a skilled artisan, flap 25 may be folded such that the complementary strips of hook and loop material 9,10 attach to one another to close opening 11. It should be recognized that other forms of non-permanent attachment means, such as buttons, snap fasteners and the like may be utilized in place of the materials 9, 10. As shown in FIG. 3B, a zipper 77 is attached to the cloth 20 and mesh 3 to close opening 11. In FIG. 3C, a combination of snap fasteners 80 and buttons 85 and receiving holes 87 are used in combination to close opening 11.

Figure 4A:
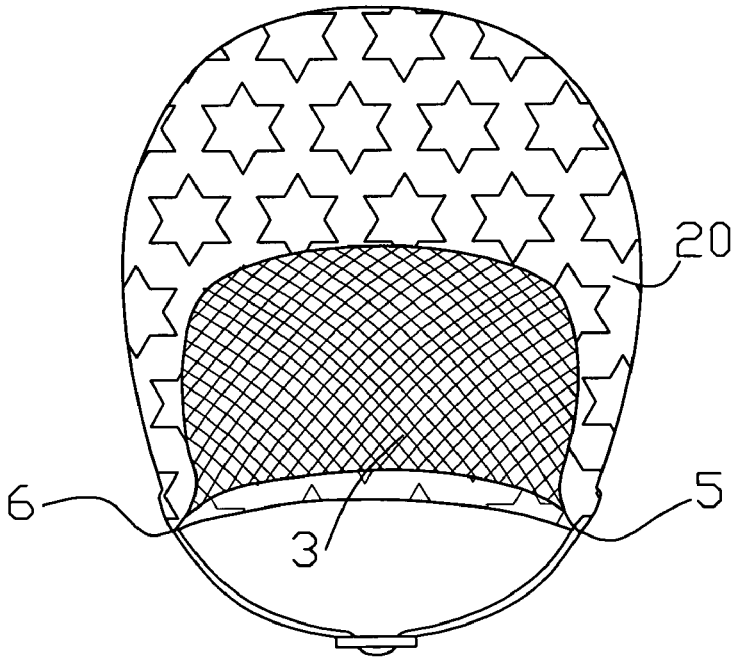
FIG. 4A is an elevation front view of the cloth version of the invention on a helmet shown in FIG. 3A.
Figure 4B:
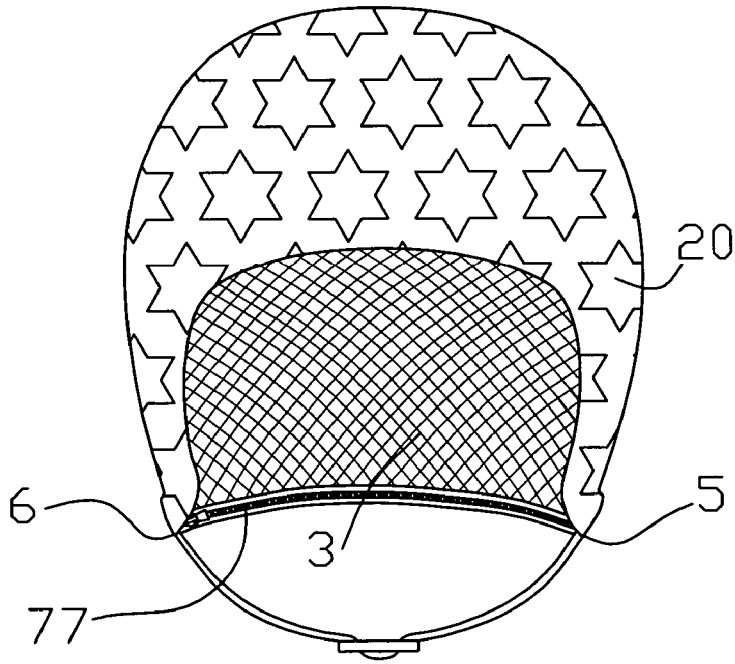
FIG. 4B is an elevation front view of the first embodiment of the invention shown in FIG. 3B.

In FIG. 4A, the motorcycle helmet 100 has been deposited into the cover 1. The mesh cloth 3 of the covering is arranged on an interior surface of the helmet to provide adequate assurance that the cover will not become displaced during riding. Other types of materials exhibiting the properties of the mesh may be utilized. However, it is important to note that the interior materials should be exhibit the properties of the mesh by being lightweight, not adversely affect the fit of the helmet, have an ability to easily stretched and not cause undue buildup of heat within the helmet. The motorcycle helmet 100 slides into the cover 1, with the cloth 2 facing outward and the mesh 3 covering the inside of the helmet. Chin straps 105 are pulled through openings 5, 6 such that the cover does not interfere with proper use of the helmet. Next, flap 25 is pulled under the helmet and fastened inside the helmet to the fastening means 9, 10. FIG. 4A corresponds to FIG. 3A whereas FIG. 3B and a zipper 77 is provided for closing opening 11.

Figure 5B:
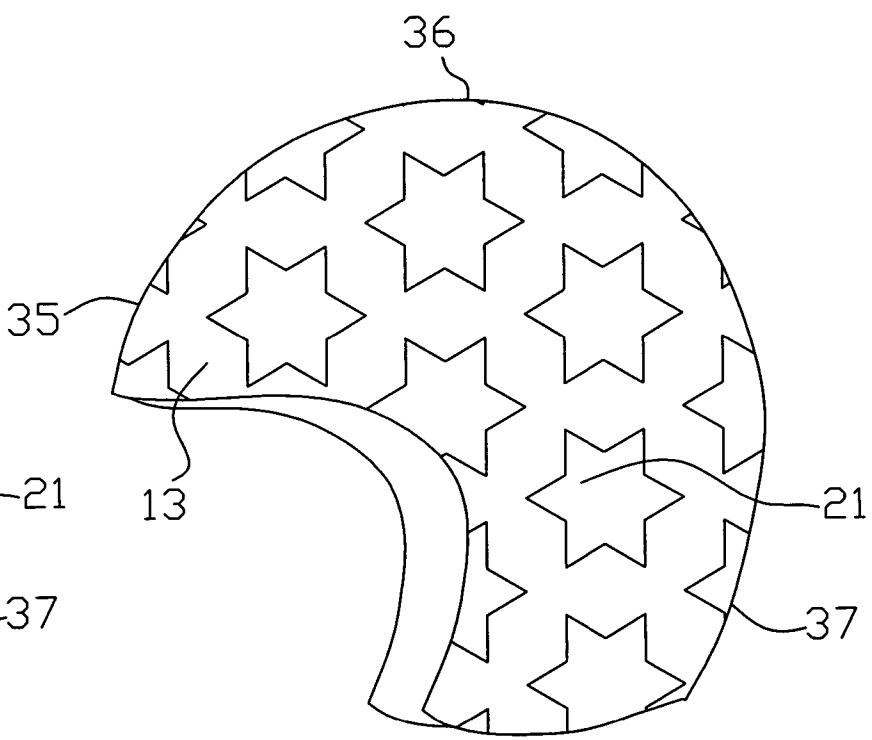
FIG. 5B is a side elevation view of the silicone skin embodiment of the invention without a lip.
Figure 5A:
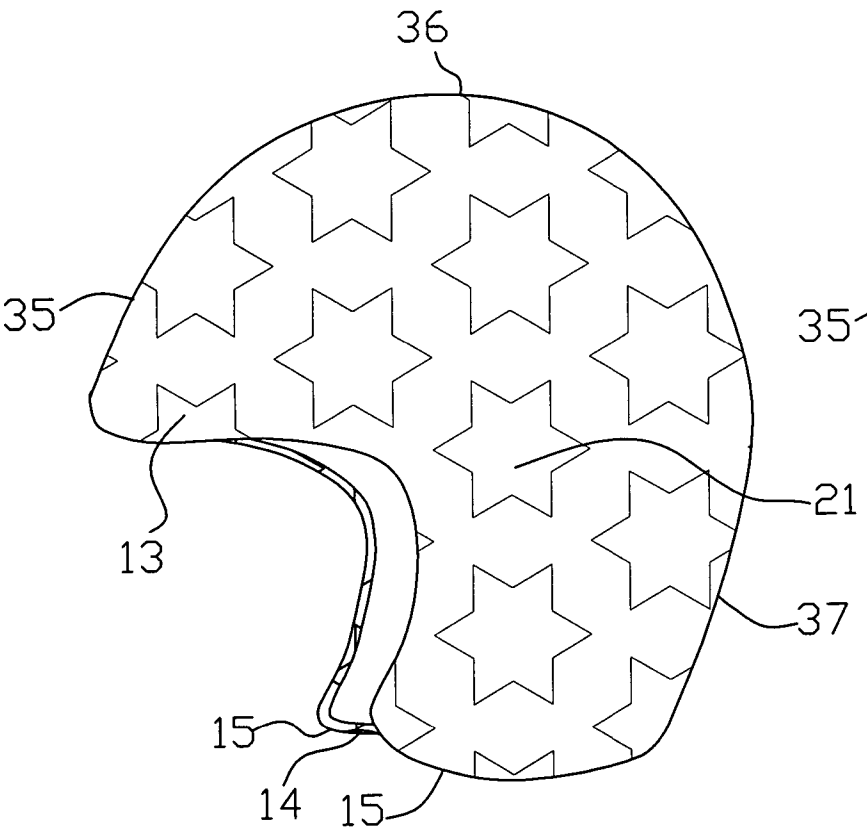
FIG. 5A is a side elevation view of the silicone skin embodiment of the invention and including a lip that wraps around an edge of the helmet shown in FIG. 1A.
Figure 6B:
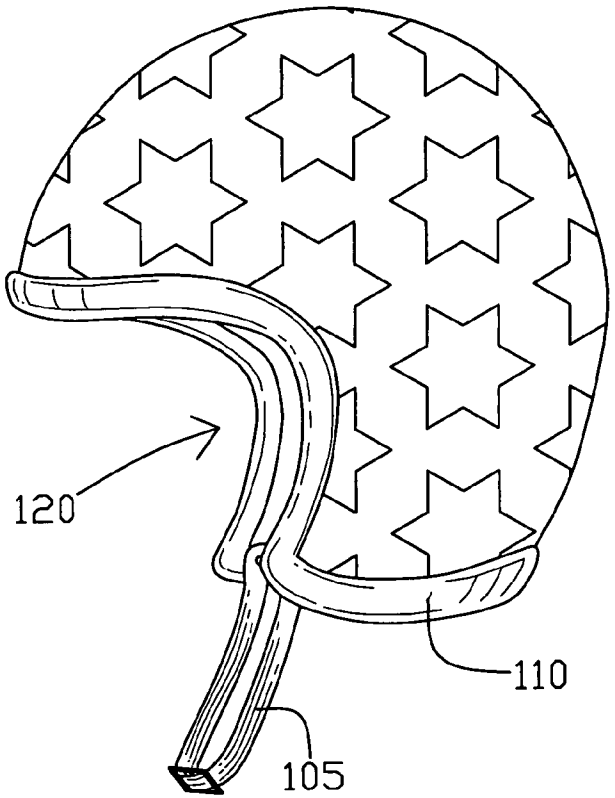
FIG. 6B is a side elevation view of the silicone skin embodiment shown in FIG. 5B.
Figure 6A:
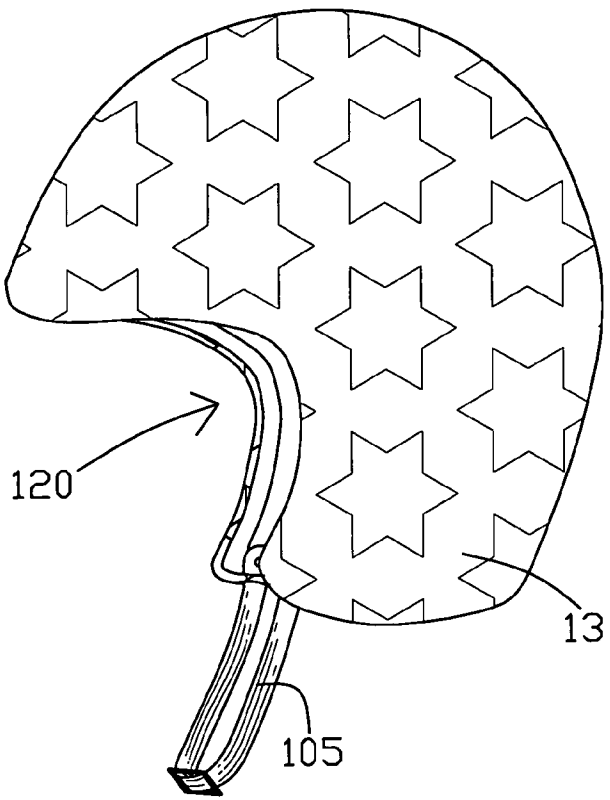
FIG. 6A is a side elevation view of the silicone skin embodiment enclosing a first helmet.
Figure 5C:
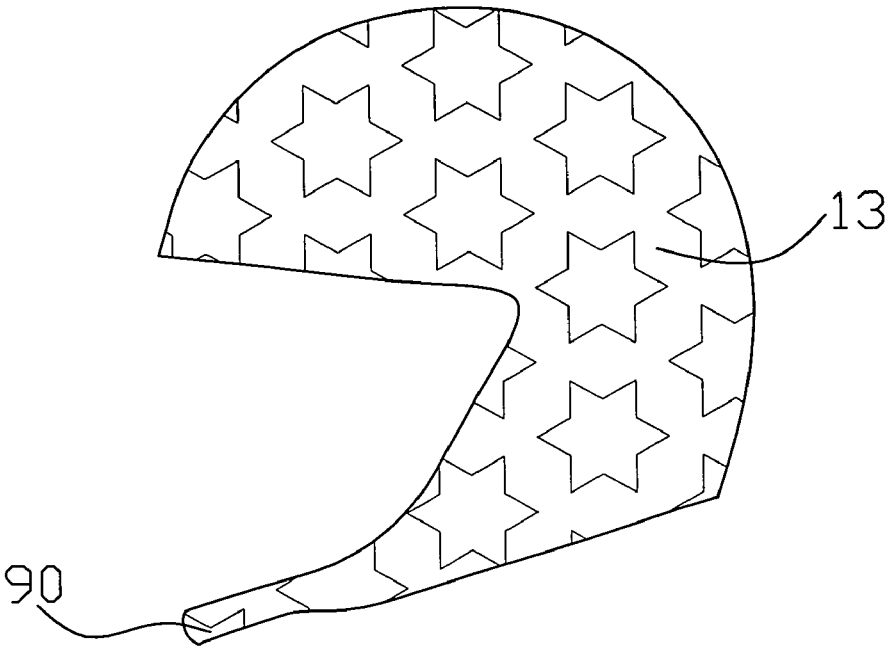
FIG. 5C is a side elevation view of the silicone skin form for the helmet shown in FIG. 1B.
Figure 6C:
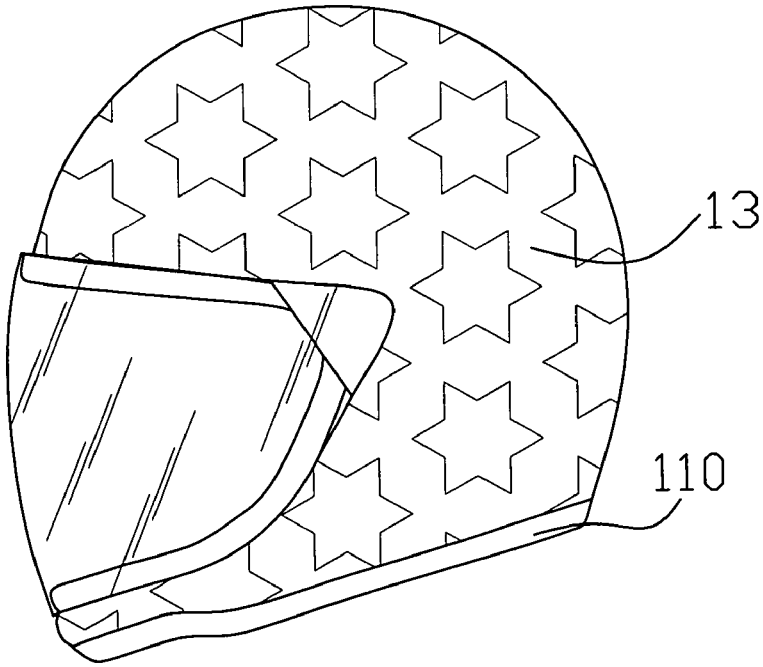
FIG. 6C is a side elevation view of the embodiment shown in FIG. 5C.

FIGS. 5A through 5C show a second embodiment of the invention. In this embodiment, the cover is formed in the shape of the exterior of surface of the helmet. Preferably, malleable silicone is used to realize the invention. In this embodiment, silicone 13 is slightly larger than the exterior surface area of the helmet, and shaped in the shape of a helmet. That is the silicone has includes a front region 35, a curved top 36 and a rounded back 37. On both sides 21 near the front region 35 of the silicone skin are open holes 14 provided to allow helmet straps 105 to be threaded through. The bottom 15 of the silicone skin comprises a lip which wraps under the helmet and clings to the inside of the helmet in FIG. 5A. A user slides the motorcycle helmet 100 into the cover 1 by stretching the skin 13 over the helmet, leaving the silicone skin facing outward 16. Next, the user pull the chin straps 105 through the openings 14. Finally, the user pulls the lip 15 under the bottom of the helmet, securing it inside the helmet 17.

In FIG. 5B, the silicone skin 13 is presented without a lip. The silicone skin's surface elasticity and surface tension cause the skin to cling to the helmet without the use of fasteners or a lip. After removing the cover from the helmet, the skin 13 will retain the shape of the helmet 1. FIG. 5C shows an additional embodiment of the invention including a small strip 90 arranged to cover lower strip 130, shown in FIG. 1B.

While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

I claim:

1. A decorative motorcycle helmet cover comprising:

an exterior piece of material having two sides, an anterior region, and a posterior region and a decorative pattern formed thereon and covering an exterior of a motorcycle helmet, said exterior piece of material having a surface area;

an interior piece of stretchable material having two sides, an anterior region, and a posterior region and a surface area that is smaller than the surface area of the exterior piece of material, the interior piece covering the inside of the motorcycle helmet;

a seam of stitching that secures the anterior regions and the sides of both the exterior piece of material and the interior piece of stretchable material together, such that an opening is created between the posterior region of the exterior piece of material and the posterior region of the interior piece of stretchable material;

a closure means arranged to close said opening;

a pair of openings arranged on either side of the cover in said seam of stitching between the anterior regions of the exterior piece of material and the interior piece of stretchable material and the posterior regions of the exterior piece of material and the interior piece of stretchable material for allowing two ends of a chin strap for securing said motorcycle helmet onto a wearer's head; and iridescent thread sewn into the exterior piece of material to aid in motorcycle safety.

2. The decorative motorcycle helmet cover of claim 1 wherein said closure means comprises complementary strips of hook and loop material fastened onto said exterior piece of material and said interior piece of stretchable material for closing said opening.

3. The decorative motorcycle helmet cover of claim 1 wherein said closure means comprises a zipper having a pair of intersecting teeth fastened onto said exterior piece of material and said interior piece of stretchable material for closing said opening.

4. The decorative motorcycle helmet cover of claim 1 wherein said closure means comprises a plurality of buttons fastened onto said exterior piece of material and said interior piece of stretchable material for closing said opening.

5. The decorative motorcycle helmet cover of claim 1 wherein said closure means comprises a plurality of snap fasteners fastened onto said exterior piece of material and said interior piece of stretchable material for closing said opening.

6. A method for covering a motorcycle helmet with a decorative cover comprising the steps of: providing a cover having an enclosure that comprises a decorative material capable of stretching, attached to a mesh fabric securing the underside of the enclosure, said enclosure having corresponding openings on both sides of the enclosure for threading through helmet straps, and an opening in the posterior of the enclosure having two edges, with both edges fabric having corresponding fastening agents; inserting a helmet through the opening in the posterior end of the enclosure, so that the decorative cloth covers the exterior and the mesh fabric clings to the interior of the helmet; threading chin straps through the corresponding openings on both sides of the cover; stretching the enclosure around the helmet such that the enclosure is substantially form fitting to the helmet; and, tightening the enclosure around the helmet using the fastening agents, so that the fastening agents are tucked into the underside of the helmet, wherein iridescent thread is sewn into the decorative material capable of stretching to aid in motorcycle safety.

7. The method of claim 6 further compromising the steps of: loosening the fastening agents on the underside of the enclosure; removing the chin straps from the corresponding openings on both sides of the cover; and, removing the helmet from the enclosure.

8. A decorative motorcycle helmet cover comprised of:

an elastic silicone skin having an edge and being fitted to the exterior of a motorcycle helmet, said elastic silicone skin including a front region that overlaps a front region of the motorcycle helmet, a curved top for being arranged on top of the motorcycle helmet, a pair of sides arranged opposite each other for overlapping sides of a motorcycle helmet and a rounded back for being arranged against a back of the motorcycle helmet, wherein the elastic silicone skin exerts a surface tension to hold the decorative helmet cover in place.

9. The decorative motorcycle helmet cover of claim 8 further comprising:

a formed lip along the edge of the elastic skin for overlapping an edge of the motorcycle helmet.

10. The decorative motorcycle helmet cover of claim 8 further comprising:

a hole in each side for the threading motorcycle helmet straps threrethrough.

* * * * *